US011864703B2

(12) United States Patent
Weyhmiller

(10) Patent No.: US 11,864,703 B2
(45) Date of Patent: Jan. 9, 2024

(54) CLEANING PAD

(71) Applicant: Bonakemi USA, Incorporated, Englewood, CO (US)

(72) Inventor: Todd Weyhmiller, Englewood, CO (US)

(73) Assignee: Bonakemi USA, Incorporated, Englewood, CO (US)

( * ) Notice: Subject to any disclaimer, the term of this patent is extended or adjusted under 35 U.S.C. 154(b) by 368 days.

(21) Appl. No.: 17/101,971

(22) Filed: Nov. 23, 2020

(65) Prior Publication Data

US 2021/0068608 A1 Mar. 11, 2021

Related U.S. Application Data

(63) Continuation of application No. 16/257,427, filed on Jan. 25, 2019, now Pat. No. 10,881,263, which is a continuation of application No. 15/208,524, filed on Jul. 12, 2016, now Pat. No. 10,231,593.

(60) Provisional application No. 62/191,929, filed on Jul. 13, 2015.

(51) Int. Cl.

| | |
|---|---|
| ***A47L 13/16*** | (2006.01) |
| ***A47L 13/256*** | (2006.01) |
| ***A47L 13/20*** | (2006.01) |
| ***A47L 11/14*** | (2006.01) |
| ***A47L 11/40*** | (2006.01) |

(52) U.S. Cl.

CPC ..... *A47L 13/16* (2013.01); *A47L 11/14* (2013.01); *A47L 11/4038* (2013.01); *A47L 13/20* (2013.01); *A47L 13/256* (2013.01)

(58) Field of Classification Search

CPC ..... A47L 13/20; A47L 13/16; A47L 13/256; A47L 11/14; A47L 11/4038

See application file for complete search history.

(56) References Cited

U.S. PATENT DOCUMENTS

| | | | |
|---|---|---|---|
| 5,142,727 | A | 9/1992 | Koester |
| 5,377,378 | A | 1/1995 | Cutler |
| 5,887,311 | A | 3/1999 | Kresse et al. |
| 6,453,502 | B1 | 9/2002 | Bishop |

(Continued)

OTHER PUBLICATIONS

International Search Report for PCT/US2016/042064 dated Oct. 25, 2016, pp. 1-3.

*Primary Examiner* — Shay Karls

(74) *Attorney, Agent, or Firm* — Parker Poe Adams & Bernstein, LLP; Amy E. Allen Hinson

(57) ABSTRACT

A method of cleaning a floor includes providing a floor cleaning apparatus with a cleaning pad having at least two parallel strips of material including at least one strip of relatively lower absorbency material, and at least one strip of relatively higher absorbency material. All of the strips of relatively lower absorbency material and relatively higher absorbency material are substantially equal height and form a substantially coplanar floor engaging surface. The floor engaging surface has a total surface area formed by the strips of relatively lower absorbency material and relatively higher absorbency material that comprise most of the total surface area of the floor engaging surface. A cleaning pad displacement apparatus is also provided. The method of cleaning the floor further incudes displacing the cleaning pad across the floor with the cleaning pad displacement apparatus.

20 Claims, 4 Drawing Sheets

(56) References Cited

U.S. PATENT DOCUMENTS

| | | | | |
|---|---|---|---|---|
| 6,979,371 | B1 | 12/2005 | Policicchio et al. | |
| 7,181,801 | B1 | 2/2007 | Kresse et al. | |
| 8,863,347 | B2 * | 10/2014 | Wildeman | A47L 13/44 15/228 |
| 2005/0022843 | A1 | 2/2005 | Policicchio et al. | |
| 2005/0081888 | A1 | 4/2005 | Pung et al. | |
| 2005/0241094 | A1 | 11/2005 | Olson | |
| 2007/0128411 | A1 | 6/2007 | Kawai et al. | |
| 2008/0289129 | A1 | 11/2008 | Kizuka et al. | |
| 2010/0263154 | A1 | 10/2010 | Wildeman et al. | |
| 2012/0042462 | A1 | 2/2012 | Milanese et al. | |
| 2012/0060312 | A1 | 3/2012 | Kubes | |
| 2013/0192082 | A1 | 8/2013 | Young | |
| 2014/0245554 | A1 | 9/2014 | Kaminer et al. | |

* cited by examiner

CLEANING PAD

This application which is a continuation-in-part of application Ser. No. 16/257,427, claims the benefit of the following U.S. patent applications: U.S. Provisional Application Ser. No. 62/191,929 filed Jul. 13, 2015; U.S. Nonprovisional application Ser. No. 15/208,524, filed Jul. 12, 2016, now U.S. Pat. No. 10,231,593, claiming priority from said U.S. Provisional Application Ser. No. 62/191,929; and U.S. application Ser. No. 16/257,427 filed Jan. 25, 2019, now U.S. Pat. No. 10,881,263, which is a continuation of application Ser. No. 15/208,524, all of which are hereby incorporated by reference for all that is disclosed therein.

BACKGROUND

Modern cleaning pads for wood floor mops are typically rectangular in shape and are removably attached, as by a hook and loop fasteners, to a mop head of similar shape. A cleaning pad often includes a fabric that is attached to the mop head and a floor engaging fabric that is attached to the first fabric. One popular cleaning pad material for floor mops is microfiber because of its ability to trap and retain dirt and absorb liquids. However, a problem with current microfiber cleaning pads is that such pads tend to glide over the floor and are thus not effective for scrubbing applications. Floor contractors often use cut pile microfiber for tacking floors. Such pads are highly moisture absorbent. However, such cut pile microfiber pads when used on a floor mop are extremely difficult to push across a floor when the pad is wet.

SUMMARY

This specification discloses a cleaning pad having at least one strip of relatively lower absorbency material such as cut pile microfiber and at least one strip of relatively higher absorbency material such as loop microfiber. Embodiments of such a cleaning pad have a combination of features including good wetting of food/dirt/small particles and low friction displacement of the mop head, provided primarily by the relatively lower absorbency material; and good moisture absorption and good food/dirt/small particle capture, provided primarily by the relatively higher absorbency material.

The Specification further discloses a floor cleaning assembly having a cleaning pad and a cleaning pad displacement apparatus. The cleaning pad has at least two parallel strips of absorbent material including at least one strip of relatively lower absorbency material and at least one strip of relatively higher absorbency material. The relatively higher absorbency material has at least about 1.36 times higher absorbency than the at least one strip of relatively lower absorbency material. All of the strips of the relatively lower absorbency material and the relatively higher absorbency material are substantially equal height and form a substantially coplanar floor engaging surface. The floor engaging surface has a total surface area formed by the strips of relatively lower absorbency material and relatively higher absorbency material that includes at least about 80% of the floor engaging surface total surface area. The floor engaging surface has a total surface area formed by strips of relatively lower absorbency material and relatively higher absorbency material that includes at least about 40% from the relatively lower absorbency material and at least about 40% from the relatively higher absorbency material. Also, the cleaning pad displacement apparatus is adapted to displace the cleaning pad across a floor surface in cleaning engagement therewith. The cleaning pad relatively higher absorbency material has an absorbency of at least about 1.6 times that of the relatively lower absorbency material. In one embodiment, the cleaning pad floor engaging surface includes at least about 50% from the relatively higher absorbency material.

DETAILED DESCRIPTION

Figure 1:
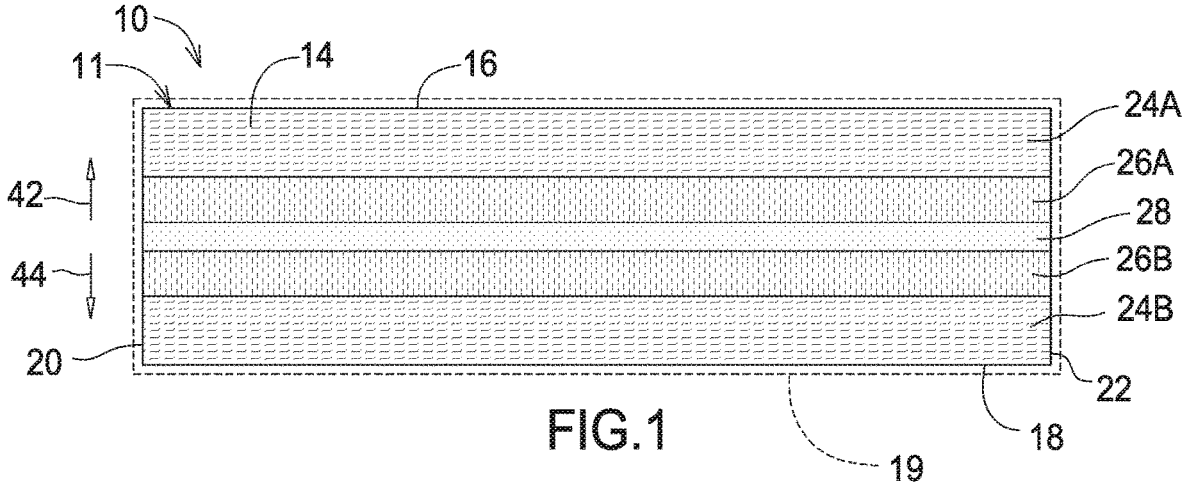
FIG. 1 is a bottom plan view an example embodiment of a cleaning pad.
Figure 2:
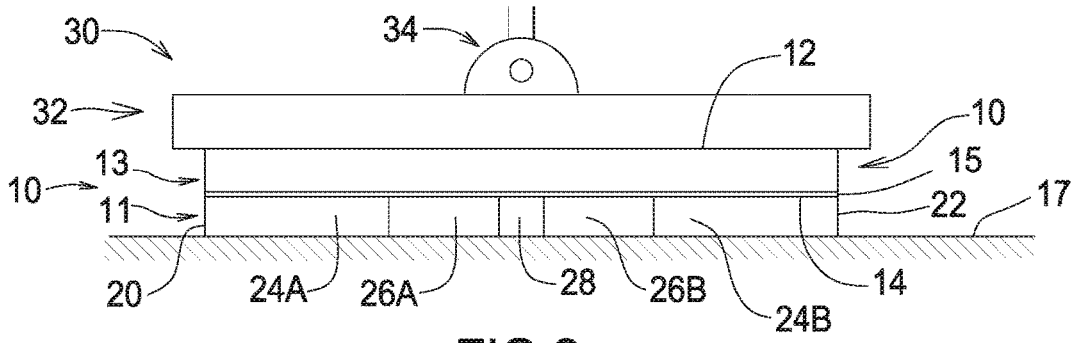
FIG. 2 is a cross-sectional side elevation view of the cleaning pad of FIG. 1 mounted on a mop.

FIG. 1 is a bottom plan view an example embodiment of a cleaning pad 10. FIG. 2 is a side elevation view of the cleaning pad 10 mounted on a mop head 32 of a floor mop 30. The mop head 32 may be conventionally attached to a mop handle assembly 34. The cleaning pad 10, as best shown in FIG. 2, has a bottom material layer 11, which makes contact with a floor surface 17 to be scrubbed, and a top material layer 13. The bottom and top layers 11, 13 are connected as by adhesive 15 or by stitching or by other attachment means.

The materials used in the bottom layer include a relatively lower absorbency material and a relatively higher absorbency material. One measure of absorbency is based on the weight of water absorbed by the material after it has been placed in a water bath for a predetermined period of time, for example 10 minutes. The amount of material tested may be specified by the surface area of the tested samples, when all samples tested have approximately the same thickness. Thus, in one testing method, the absorbency of the material is expressed in grams of water absorbed per square centimeter of material.

In one example embodiment, for the relatively lower absorbency material, the water absorption per unit area was about 0.226 g/cm$^2$. Performing the same test on the strip of relatively higher material, the water absorption per unit area was about 0.308 g/cm$^2$. Thus, the relatively higher material had an absorption rate about 1.36 times higher than that of the relatively lower absorbency material. In another embodiment, the relatively higher material had an absorption rate about 1.60 times higher than that of the relatively lower absorbency material.

The top layer 13 of the pad 10 may be a unitary sheet of fabric that may be made from cotton, wool, or a manmade fiber such as nylon, or other backing material. In one embodiment the top layer 13 (sometimes referred to herein as "backing material") has a composition of 100% polyester. As best shown in FIG. 1, the pad bottom layer 11, which may be generally rectangular in shape, has first and second longitudinal edges 16, 18 and first and second lateral edges 20, 22. In some embodiments a strip of fabric material 19, shown in dashed lines, is folded over the bottom and top layers 11 and 13. The strip 19 is attached to the pad at its outer edges 16, 18, 20, 22 by stitching or other attachment means. The bottom layer 13 is composed of multiple laterally extending, parallel strips of material that may be sewn or otherwise connected at the abutting edges thereof. In the example embodiment shown in FIG. 1 the bottom layer 11 is formed by two outer strips of relatively lower absorbency material 24A and 24B, two inner strips of relatively higher absorbency material 26A and 26B and a central strip of scrubbing/bristle material 28.

In one embodiment the scrubbing/bristle material is white nylon bristles, in another it is polyester scrubbers—a stiff, brush like material. However, the bristles could be made from any sufficiently stiff and wear resistant manmade material, plant fiber or animal hair. The bristles, as well as improving the scrubbing efficiency of the mop, are very useful when encountering bevel or gout lines where current mops do not perform well. The scrubbing/bristle material has a very low water absorption per unit area. In most example embodiments, the water absorption per unit area is negligible.

The relatively lower absorbency material 24A, 24B could be any of the following materials, or other materials: 100% polyester twist loop microfiber material or 2 Denier 100% polyester 1 ply material.

The relatively higher absorbency material 26A, 26B could be any of the following materials, or other materials: cut pile microfiber, or an 80/20 Polyester/Nylon blend, untwisted composition material or an 80% Polyester, 20% Polyamide, 3 plies material.

In the embodiment of FIG. 1, the relatively lower absorbency material 24A, 24B occupies about 50% of the total surface area, the relatively higher absorbency material 26A, 26B occupies about 40% and the scrubbing/bristle material occupies about 10%. In a slightly different version, the strip layout order is the same, except that the relatively lower absorbency material strips 24A, 24B occupy about 40% of the total surface area, the relatively higher absorbency material strips 26A, 26B occupy about 50% of the total surface area and the scrubbing/bristle material strip 28 occupies about 10% of the total surface area. Other strip area ratios may also be used. As best shown by FIG. 2, in one embodiment, the strips of relatively higher absorbency material 26A, 26B and the strips or relatively lower absorbency material 24A, 24B are substantially equal height such that the bottom surfaces of the strips are substantially coplanar and all simultaneously engage the floor surface 17.

Figure 3:
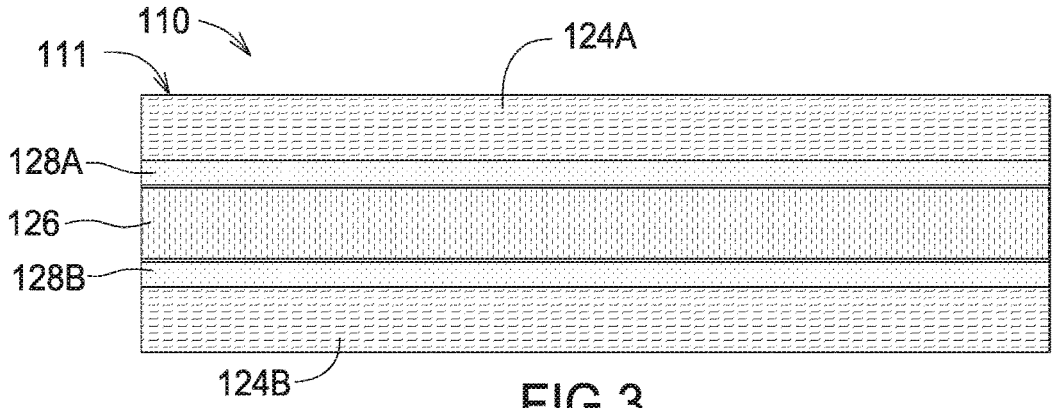
FIG. 3 is a bottom plan view of another example embodiment of a cleaning pad.

FIG. 3 is a bottom plan view of a cleaning pad 110 of the same type as the cleaning pad 10 shown in FIG. 1, but with a different arrangement of material strips in the bottom layer 111 thereof. In this embodiment a relatively higher absorbency material strip 126 is located at the center of the bottom layer 111. A scrubbing/bristle material strip 128A or 128B is attached to either side of the cut pile strip 126. A relatively lower absorbency material strip 124A and 124B is attached to each of the scrubbing/bristle material strips 128A, 128B, respectively. The area ratios of each strip type may be the same as in the two versions of the cleaning pad 11 described above with reference to FIG. 1, i.e., in a first version the relatively lower absorbency material strips occupy about 50% of the total surface area, the relatively higher absorbency material strips occupy about 40% and the scrubbing/bristle material strip occupies about 10%. In a second version, the relatively lower absorbency material strips occupy about 40% of the total surface area, the relatively higher absorbency material strips occupy about 50% of the total surface area and the scrubbing/bristle material strip occupies about 10% of the total surface area. In the embodiment of FIG. 3, the scrubbing/bristle material strips 128A, 128B may each be about 60 mm wide in both of the different area ratio versions.

One advantage of some embodiments of the cleaning pads illustrated in FIGS. 1-3 is that most consumers using such a cleaning pad on a mop, would be able to push the mop across a wood floor without difficulty.

Figure 4:
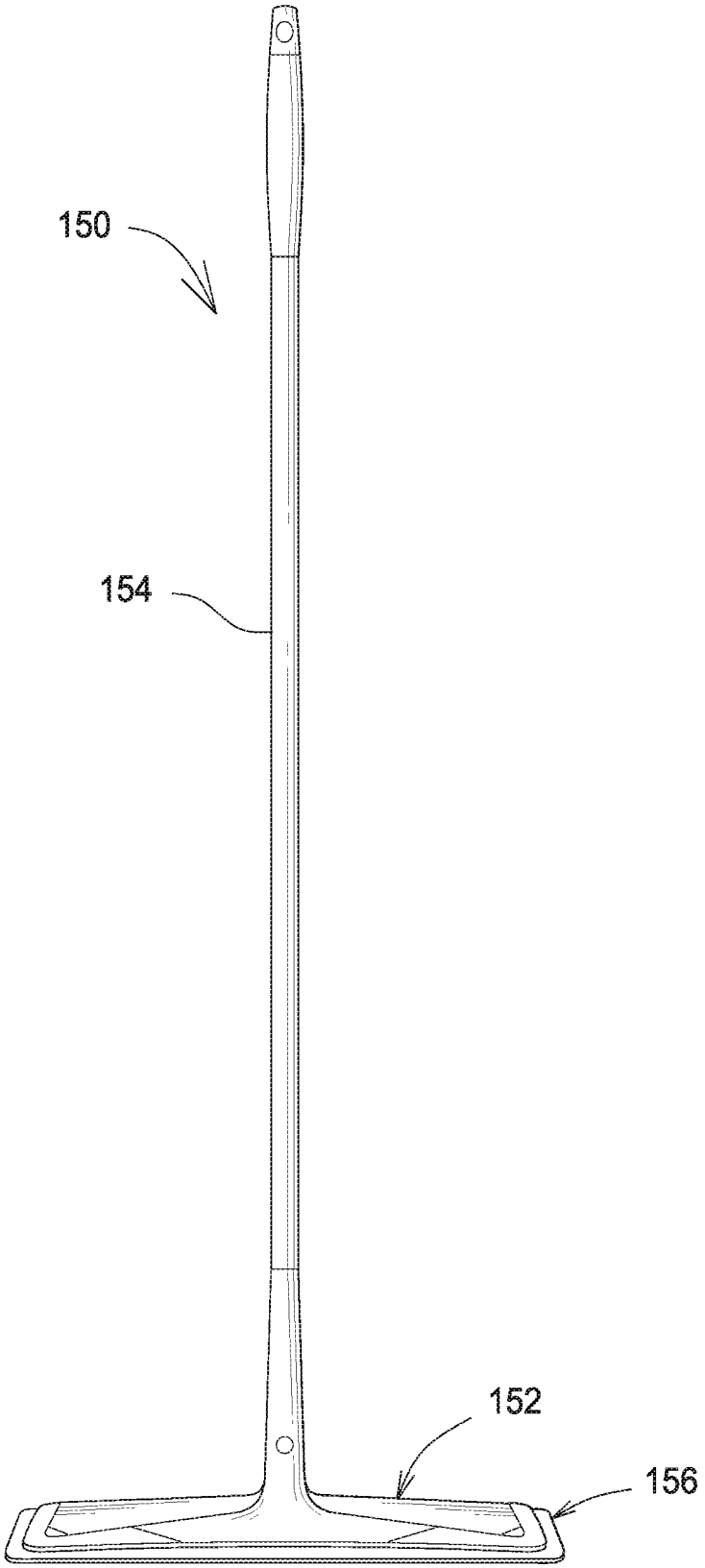
FIG. 4 is an isometric view of a floor mop that includes the cleaning pad of FIG. 1.

FIG. 4 illustrates a floor mop 150 having a mop head 152 with an elongate handle 154 attached thereto. A cleaning pad 156, which may be similar or identical to the cleaning pads 10 or 110 described herein, is attached to the bottom of the mop head 152 as by hook and loop fasteners or other attachment means. Thus, the floor mop 150 may comprise a mop head 152 having attached thereto a cleaning pad 156. The cleaning pad has at least one strip of relatively lower absorbency material, e.g., strip 24A (FIG. 1), at least one strip of relatively higher absorbency material, e.g., strip 26A (FIG. 1) and at least one strip of scrubbing/bristle material, e.g., strip 28 (FIG. 1).

Figure 5:
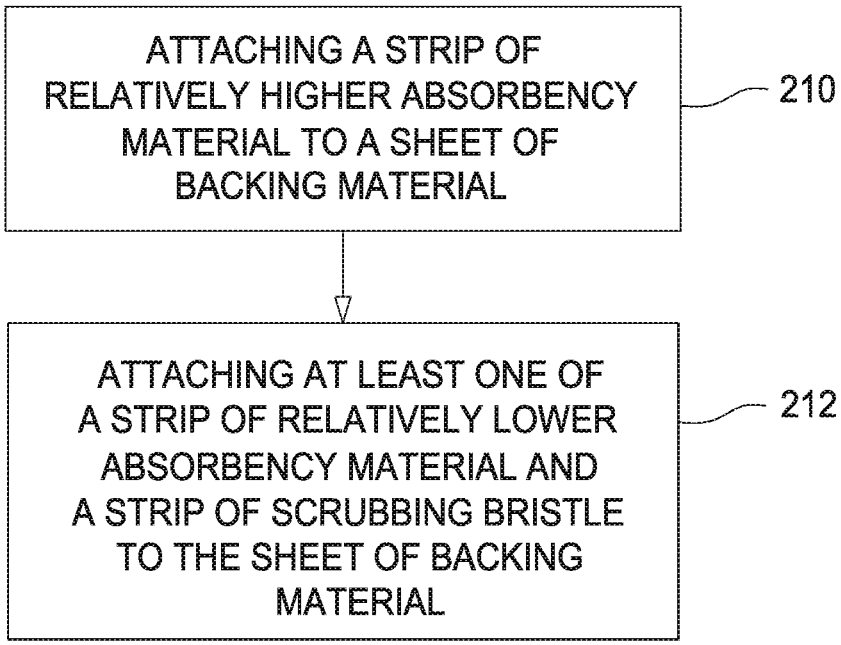
FIG. 5 is a flow diagram of a method of making a cleaning pad.

FIG. 5 is a flow diagram of an example method of making a cleaning pad. The method, in one embodiment, includes, as shown at block 210, attaching a strip of relatively higher absorbency material to a sheet of backing material. The method may also include, as shown at block 212, attaching at least one of a strip of relatively lower absorbency material and a strip of scrubbing/bristle material to the sheet of backing material.

The strips may be linear strips positioned in a parallel relationship as shown in FIGS. 1 and 3. However, the strips may be otherwise arranged, for example, the strips may be divided into small squares and arranged in a checkerboard pattern (not shown). Also, rather than being linear, the strips could have a snake-like, undulating configurations (not shown), or other configurations.

Figure 7:
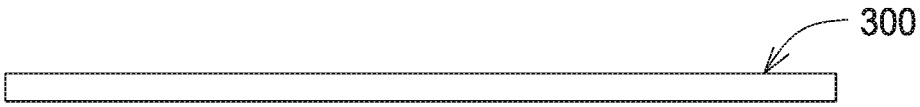
FIG. 7 is a side elevation view of another example embodiment of a cleaning pad.

In some embodiments the backing material, e.g. top material layer 13 is eliminated and the various strips of relatively lower absorbency material, relatively higher absorbency material and scrubbing/bristle material are attached at adjacent edges thereof directly to one another, for example, such as shown in FIG. 1 or 3. A side elevation view of such a cleaning pad 300 is illustrated in FIG. 7.

Figure 6:
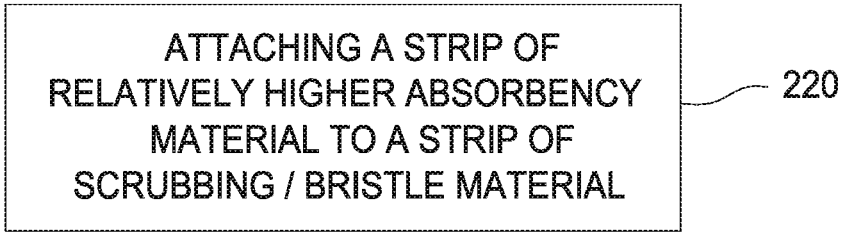
FIG. 6 is a flow diagram of another method of making a cleaning pad.

FIG. 6 is a block diagram of another embodiment of a method of making a cleaning pad. The method includes, as shown in block 220, attaching a strip of relatively higher absorbency material to a strip of scrubbing/bristle material. Other methods include the method of FIG. 6 and further steps, for example: attaching a second strip of relatively higher absorbency material to the strip of scrubbing/bristle material and attaching a first and second strip of relatively lower absorbency material to the first and second strips of relatively higher absorbency material, respectively. Still other embodiments include the method of FIG. 6 and further comprise attaching a strip of relatively higher absorbency material to the strip of scrubbing/bristle material; and may further include attaching a second strip of scrubbing/bristle material to the strip of relatively higher absorbency material and may further include attaching a second strip of relatively lower absorbency material to the second strip of scrubbing/bristle material.

Figure 8:
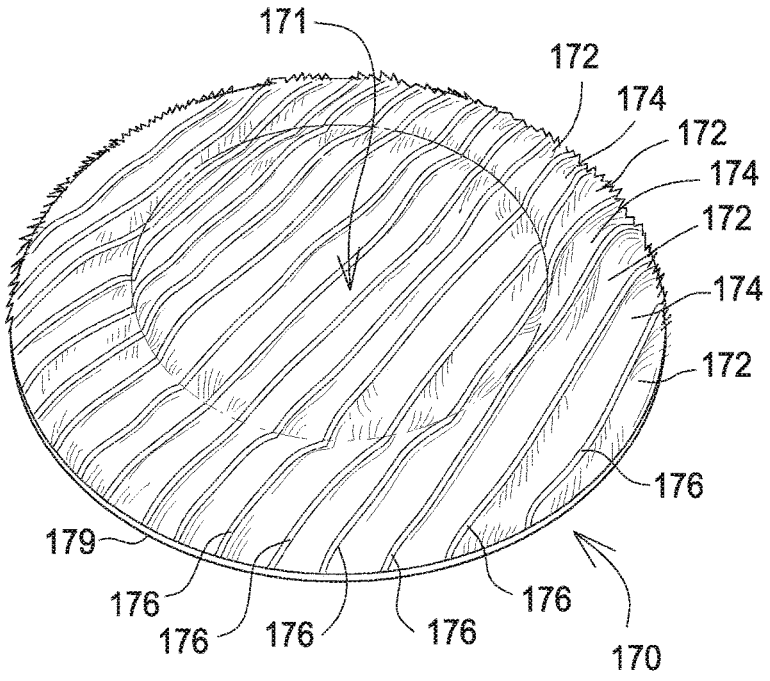
FIG. 8 is a bottom plan view of an example embodiment of a cleaning bonnet for a rotary floor care machine.

FIG. 8 is a bottom plan view of an example embodiment of a cleaning bonnet 170 for a rotary floor care machine. The cleaning bonnet comprises a floor engaging face 171 having alternating higher absorbency strips 172 and lower absorbency strips 174 with harder surfaces scrubbing material strips 176 positioned between each pair of higher absorbency strips 172 and lower absorbency strips 174. The higher absorbency strips 172 and lower absorbency strips 174 may be constructed from the same material as described above for the cleaning pad 10 or may be made from other materials. The scrubbing material strips 176 may be made of nylon or other scrubbing material.

Figure 9:
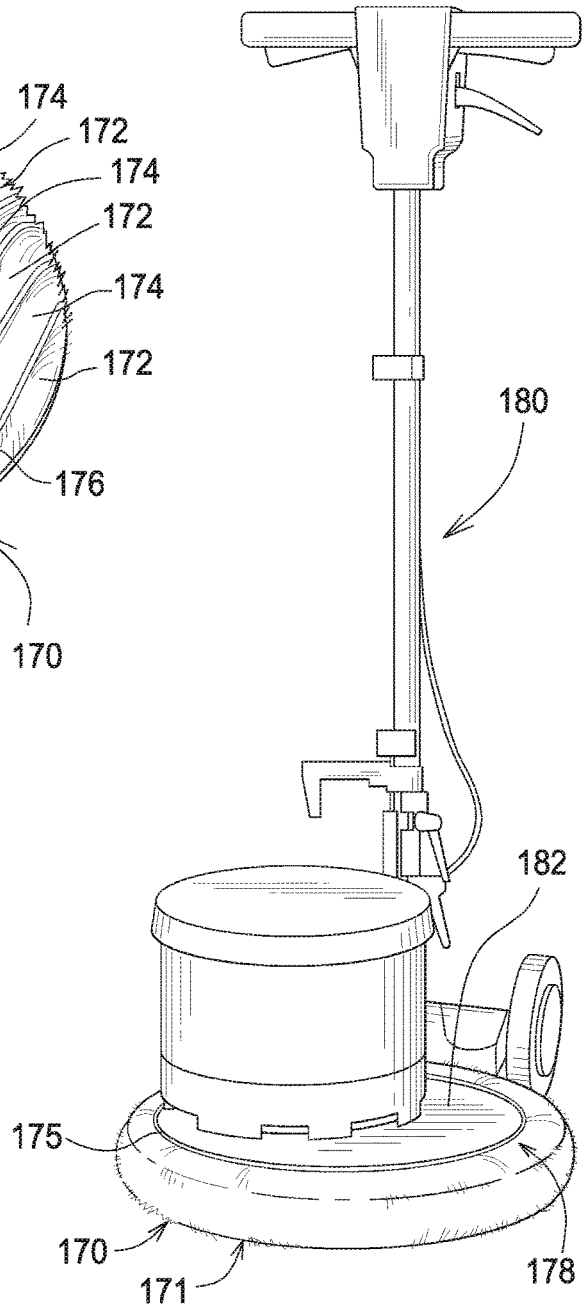
FIG. 9 is a side elevation view of a rotary floor care machine having a cleaning bonnet mounted thereon.

FIG. 9 is a side elevation view of a rotary floor care machine 180, such as a buffer having a cleaning bonnet mounted thereon. A sander (not shown) may be substituted for the buffer in some embodiments. The rotary floor care machine 180 has a rotary head 182. The cleaning bonnet 170 has a skirt portion 178 attached to the face 171 as by a seam or material strip 179. The skirt portion 178 encompasses a peripheral portion of the rotatory head. A draw string 175 or elastic band or other securing means provided at the edge of the skirt securely fastens it to the rotating head 182.

Various embodiments of cleaning pads, mop assemblies with cleaning pads and methods of making cleaning pads have been disclosed in detail herein. Alternative embodiments of such cleaning pads, mop assemblies and associated methods will occur to those skilled in the art after reading this disclosure. It is intended that the appended claims be construed broadly to cover such alternative embodiments, except as limited by the prior art.

What is claimed is:

1. A floor cleaning assembly comprising:

a cleaning pad having at least two parallel strips of absorbent material including at least one strip of relatively lower absorbency material and at least one strip of relatively higher absorbency material, which has at least about 1.36 times higher absorbency than said at least one strip of relatively lower absorbency material; wherein all of said strips of said relatively lower absorbency material and said relatively higher absorbency material are substantially equal height and form a substantially coplanar floor engaging surface, wherein said floor engaging surface has a total surface area formed by said strips of relatively lower absorbency material and relatively higher absorbency material that comprises at least about 80% of said floor engaging surface total surface area; and a cleaning pad displacement apparatus adapted to displace said cleaning pad across a floor surface in cleaning engagement therewith.

2. The floor cleaning assembly of claim 1, said cleaning pad further comprising a sheet of backing fabric and wherein said at least one strip of relatively lower absorbency material, said at least one strip of relatively higher absorbency material are attached to said sheet of backing fabric.

3. The floor cleaning assembly of claim 1, said cleaning pad comprising:

two strips of said relatively lower absorbency material.

4. The floor cleaning assembly of claim 1, said cleaning pad comprising:

one strip of relatively higher absorbency material and two strips of relatively lower absorbency material.

5. The floor cleaning assembly of claim 1 wherein said cleaning pad floor engaging surface comprises at least about 50% from said relatively higher absorbency material.

6. The floor cleaning assembly of claim 1, wherein said cleaning pad relatively higher absorbency material has an absorbency of at least about 1.6 times that of said relatively lower absorbency material.

7. The floor cleaning assembly of claim 1, said cleaning pad relatively lower absorbency material comprising loop microfiber.

8. The floor cleaning assembly of claim 1, said cleaning pad relatively higher absorbency material comprising cut microfiber.

9. The floor cleaning assembly of claim 1, said cleaning pad relatively lower absorbency material comprising a 100% polyester composition.

10. The floor cleaning assembly of claim 1, said cleaning pad relatively higher absorbency material comprising about 80% polyester and 20% nylon.

11. The floor cleaning assembly of claim 1, said cleaning pad further comprising at least one strip of cleaning/scrubbing bristle.

12. The floor cleaning assembly of claim 1, said cleaning pad displacement apparatus having a nonrotatable portion on which said cleaning pad is mounted.

13. The floor cleaning assembly of claim 1, said cleaning pad displacement apparatus having a rotatable portion on which said cleaning pad is mounted.

14. The floor cleaning assembly of claim 1, said cleaning pad displacement apparatus being electrically powered.

15. The floor cleaning assembly of claim 1, wherein said floor engaging surface has a total surface area formed by said strips of relatively lower absorbency material and relatively higher absorbency material that comprises at least about 40% from said relatively lower absorbency material and at least about 40% from said relatively higher absorbency material.

16. A method of cleaning a floor comprising:

a) providing a floor cleaning apparatus with:

a cleaning pad having at least two parallel strips of absorbent material including at least one strip of relatively lower absorbency material and at least one strip of relatively higher absorbency material, which has at least about 1.36 times higher absorbency than said at least one strip of relatively lower absorbency material; wherein all of said strips of said relatively lower absorbency material and said relatively higher absorbency material are substantially equal height and form a substantially coplanar floor engaging surface, wherein said floor engaging surface has a total surface area formed by said strips of relatively lower absorbency material and relatively higher absorbency material that comprises at least about 80% of said total surface area of floor engaging surface; and a cleaning pad displacement apparatus adapted to displace said cleaning pad across a floor surface in cleaning engagement therewith; and b) displacing said cleaning pad across a floor in cleaning engagement therewith with said cleaning pad displacement apparatus.

17. The method of claim 16 comprising maintaining said cleaning pad in nonrotatable relationship relative the rest of said floor cleaning apparatus as said cleaning pad is displaced across the floor.

18. The method of claim 16 comprising rotating said cleaning pad relative the rest of said floor cleaning apparatus as said cleaning pad is displaced across the floor.

19. The method of claim 16 comprising powering said cleaning pad displacement apparatus with electricity.

20. A floor cleaning assembly comprising:

a) a cleaning pad comprising at least two strips of material including at least one strip of relatively lower absorbency material and at least one strip of relatively higher absorbency material, which has at least about 1.36 times higher absorbency than said at least one strip of relatively lower absorbency material; wherein all of said strips of said relatively lower absorbency material and said relatively higher absorbency material are substantially equal height and form a substantially coplanar floor engaging surface, wherein said substantially coplanar floor engaging surface has a total surface area formed mostly by said strips of said relatively lower absorbency material and said strips of said relatively higher absorbency material; and b) cleaning pad displacement apparatus adapted to displace said cleaning pad across a floor surface in cleaning engagement therewith.

* * * * *